United States Patent [19]

Weinstein

[11] Patent Number: 4,657,184

[45] Date of Patent: Apr. 14, 1987

[54] FLUID TIP AND AIR CAP ASSEMBLY

[75] Inventor: Richard Weinstein, Toledo, Ohio

[73] Assignee: Champion Spark Plug Company, Toledo, Ohio

[21] Appl. No.: 824,761

[22] Filed: Jan. 31, 1986

[51] Int. Cl.[4] ..... B05B 7/08

[52] U.S. Cl. ..... 239/296

[58] Field of Search ..... 239/299–301, 239/704, 705

[56] References Cited

U.S. PATENT DOCUMENTS

| | | | |
|---|---|---|---|
| 1,770,164 | 7/1930 | Paache | 239/300 X |
| 3,195,819 | 7/1965 | Watanabe | 239/290 X |

FOREIGN PATENT DOCUMENTS

| | | | |
|---|---|---|---|
| 2446022 | 4/1976 | Fed. Rep. of Germany | 239/705 |
| 2702191 | 8/1978 | Fed. Rep. of Germany | 239/290 |
| 35394 | 8/1953 | Poland | 239/296 |

*Primary Examiner*—Andres Kashnikow

*Attorney, Agent, or Firm*—Oliver E. Todd, Jr.

[57] ABSTRACT

A fluid tip and air cap assembly for use in a spray gun is disclosed. A spray cap having a central opening also defines an internal threaded opening. A fluid tip is connected to the spray cap by a plurality of mating threads. A tip member of the fluid tip is concentrically and axially aligned, in a predetermined relationship, with the central opening of the spray cap.

5 Claims, 4 Drawing Figures

FIG. 3
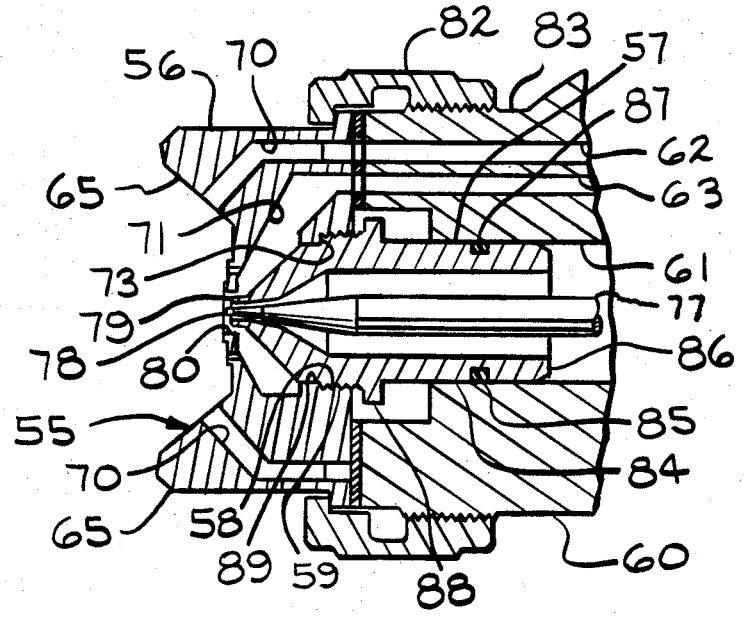
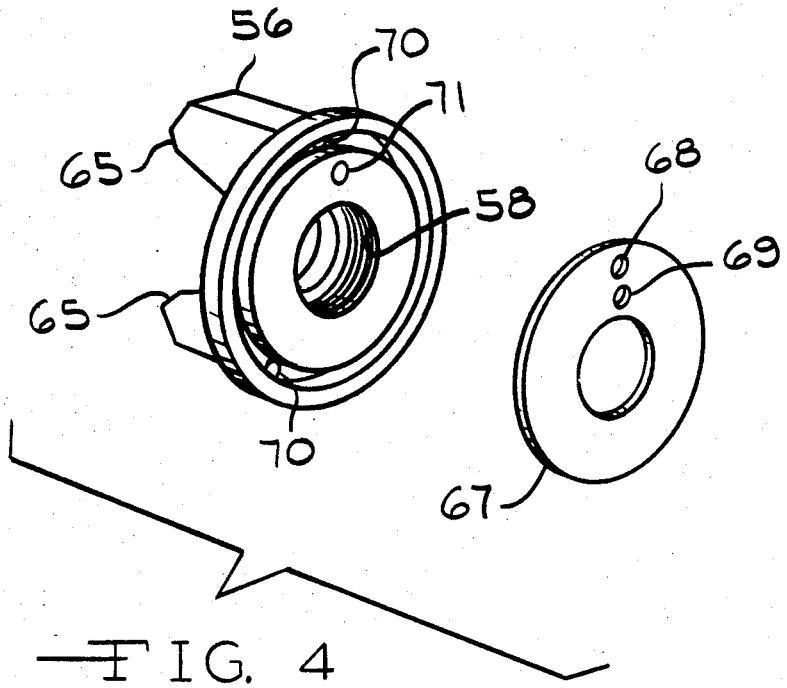
FIG. 4

FLUID TIP AND AIR CAP ASSEMBLY

BACKGROUND OF THE INVENTION

The present invention is directed to a fluid tip and air cap assembly which is used in spray guns for spraying fluent material such as liquid paints or powder paints. The fluid tip and air cap assembly, according to the present invention, is suitable for use with a completely pneumatic spray gun or in the alternative, a combination pneumatic and electrostatic spray gun.

In many prior art spray guns, a fluid tip is connected to and extends from the central bore of the main spray gun body. Often, such a fluid tip includes a conical surface adjacent the front of the gun. A separate air cap is mounted over the fluid tip. The air cap is often held by a lock ring or lock nut to the main spray gun body. In some cases, the prior art air caps included an inner conical surface which contacts the conical surface of the fluid tip in an effort to obtain correct alignment.

One of the major problems with prior art spray guns is that the central opening of the air cap must be concentrically aligned with the forwardly extending tip of the fluid tip. In addition, these same two elements must also be axially aligned relative to the longitudinal central axis of the central bore of the spray gun. If either of these alignments is incorrect, a faulty spray pattern results.

Bartling U.S. Pat. No. 1,539,536 discloses the use of interchangeable nozzles which are threaded to the air cap. However, in Bartling as is true with many prior art structures, the fluid tip and the air cap are not connected to one another, thereby providing an opportunity for misalignment.

SUMMARY OF THE INVENTION

The present invention is directed to a fluid tip and air cap assembly which is inserted into the central bore of the spray gun and then connected by a lock ring or lock nut to the exterior of the spray gun in the normal fashion. The fluid tip and air cap assembly according to the present invention has the great advantage of being prealigned both concentrically and axially upon connection to the spray gun. The fluid tip and air cap assembly can easily be removed, cleaned and reinserted while maintaining such correct alignments.

The fluid tip and air cap assembly includes a spray cap having a central opening for the discharge of the fluent material, such as paint, from the spray gun. Opposed horns are positioned on the spray cap and auxiliary air passages are provided for shaping the fluent material. The spray cap defines an internal threaded opening. A stop surface is provided at one end of the threaded opening. A fluid tip is connected to the spray cap. The fluid tip includes a tip member which is mounted concentrially relative to the central opening of the spray cap. A tubular body extends rearwardly from the tip member. The body defines a plurality of threads for mating engagement with the internal threaded opening of the spray cap. A stop member is defined on the fluid tip for engagement with the stop surface of the spray cap. The engagement of the cooperative stop surface and stop member axially align the central opening of the spray cap and the tip member in a predetermined relationship.

Preferably, a wrench land extends outwardly from the tubular body and an O-ring is mounted on the tubular body. The end of the tubular body which mounts the O-ring is positioned within the central bore of the main spray gun, upon assembly.

BRIEF DESCRIPTION OF THE DRAWINGS

FIG. 3 is a fragmentary sectional view of another embodiment of a fluid tip and air cap assembly, according to the present embodiment; and FIG. 4 is an exploded view showing the air cap of the FIG. 3 embodiment and a seal ring.

BRIEF DESCRIPTION OF THE PREFERRED EMBODIMENTS

Figures 1, 2:
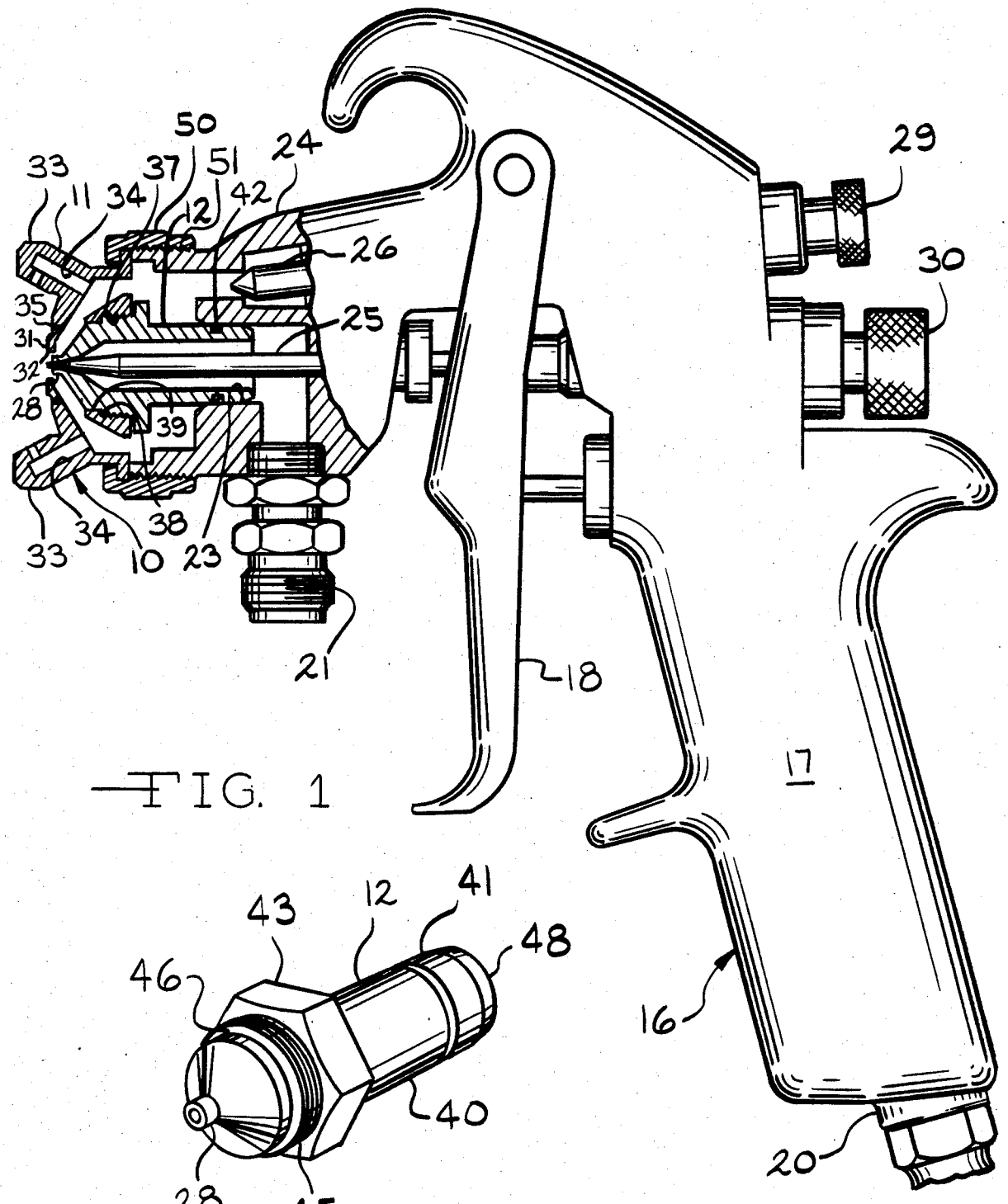
FIG. 1 is an elevational view, partially in cross-section, showing a spray gun having a fluid tip and air cap assembly according to the present invention.
FIG. 2 is an enlarged perspective view of the fluid tip portion of the fluid tip and air cap assembly, according to the present invention.

A fluid tip and air cap assembly, according to the present invention, is generally indicated in FIG. 1 by the reference number 10. The assembly 10 includes an air cap or spray cap 11 which is connected to a fluid tip 12.

A spray gun 16 includes a handle 17 and a trigger 18. In the present embodiment, the spray gun 16 comprises an air operated or pneumatic spray gun used for spraying fluent materials such as liquid paints or powder paints. However, the fluid tip and air cap assembly 10, according to the present invention, is also suitable for use on other types of spray guns, including electrostatic spray guns.

The spray gun 16 includes an air inlet 20 and a paint or material inlet 21. A paint or material mixture travels through a central bore 23 defined by a main body 24 of the spray gun 16. The trigger 18 operates a pair of needle valves 25 and 26. The needle valve 25 controls the flow of paint emanating from a tip member 28 of the fluid tip 12, while the needle valve 26 regulates the flow of auxiliary air which is directed to the spray cap 11. An adjustment knob 29 is provided for the needle valve 26 and an adjustment knob 30 for the needle valve 25.

Referring to FIG. 1, the spray cap 11 defines an annular opening 32 for the discharge of air to atomize the fluent material emanating from the tip member 28 of the fluid tip 12. The spray cap 11 also includes opposed horns 33 which define air passages 34. Other air passageways 35 are provided in the spray cap 11 adjacent the annular opening 32. The auxiliary air passages 34 and 35 shape the fluent material emanating from the spray gun 16.

The spray cap 11 has an internal threaded opening 37. At one end of the threaded opening 37, a stop surface 38 is defined by the spray cap 11.

Referring to FIGS. 1 and 2, the fluid tip 12 includes a tubular body 40 which extends rearwardly from the tip member 28. A groove 41 is defined in the outer surface of the tubular body 40 and receives an O-ring 42. In a preferred embodiment, a wrench land 43 extends outwardly from the tubular body 40 of the fluid tip 12. The tubular body 40 defines a plurality of threads 45 for mating engagement with the internal threaded opening 37 of the spray cap 11. A stop shoulder or stop member 46 is defined by the fluid tip 12 adjacent the threads 45. When the spray cap 11 and fluid tip 12 are threaded together, as shown in FIG. 1, the stop member 46 of the fluid tip 12 engages the stop surface 38 of the spray cap 11. When this engagement occurs, the tip member 28 of the fluid tip 12 is aligned concentrically with the annular opening 32 of the spray cap 11. This results from the radial fit 39, between the spray cap 11 and the fluid tip 12. The tip member 28 is also aligned axially, with respect to the face 31 of the air cap 11, in a predetermined relationship along the longitudinal axis defined by the central bore 23 of the spray gun 16. In this manner, when the fluid tip and air cap assembly 10 is disengaged and cleaned, upon reassembly the predetermined axial and radial relationships are maintained.

During assembly or reassembly, after the spray cap 11 and fluid tip 12 are threaded together with the stop member 46 being positioned against the stop surface 38, an end 48 of the tubular body 40 is inserted into the central bore 23 of the spray gun 16. The O-ring 42 ensures a proper seal with the central bore 23. A lock ring 50 connects the spray cap 11 to an outer threaded portion 51 of the main body 24 of the spray gun 16.

Referring to FIGS. 3 and 4, another embodiment of a fluid tip and air cap assembly, according to the present invention, is generally indicated by the reference number 55. The assembly 55 includes an air or spray cap 56 and a fluid tip 57. The spray cap 56 is provided with an internal threaded opening 58 which receives a threaded portion 59 of the fluid tip 57. The fluid tip and air cap assembly 55 is mounted within a spray gun 60 having a central bore 61, a horn air passageway 62 and an atomizing air passageway 63.

The spray cap 56 includes a pair of opposed horsn 65. A ring seal 67 defines a horn opening 68 and an atomizing opening 69. The horn air passageway 62 and the horn opening 68 of the ring seal 67 are in communication with horn passageways 70 which are defined in the opposed horns 65. The spray cap 56 also defines, together with the fluid tip 57, an atomizing air chamber 71 which is in communication with the atomizing air passageway 63 and the atomizing opening 69 in the ring seal 67.

The spray cap 56 has a stop surface 73 and the fluid tip 57 has a stop shoulder or stop member 74 which engages the stop surface 73 upon placing the assembly 55 in the mating threaded relationship shown in FIG. 3. An interface surface 89 of the spary cap 56 and the fluid tip 57 assures an even annular opening defined between the spray cap central opening 80 and the fluid tip member 79. The spray gun 60 includes a main needle valve 77 which controls the flow of paint through a central passage 78 defined in a tip member 79 at the front end of the fluid tip 57.

The spray cap 56 of the assembly 55 defines a central opening 80. Upon assembly of the spray cap 56 and the fluid tip 57 into the mating position shown in FIG. 3, the tip member 79 is held in a precise concentric relationship with the central opening 80 of the spray cap 56. In addition, the tip member 79 is held in a predetermined axial relationship with the front surface of the spray cap 56. As noted above with respect to the first embodiment, upon disassembly, cleaning and reassembly of the fluid tip and air cap, the precise concentric relationship and predetermined axial relationship is again established. The embodiment shown in FIGS. 3 and 4 is particularly suitable for an electrostatic spray gun where the auxiliary air and horn air are separately remotely controlled. The present fluid tip and air cap assembly 55 provides excellent fluid sealing. The ring seal 67 is positioned adjacent the spray cap 56. Upon tightening of a lock ring 82, which attaches the assembly 55 to the outer portion 83 of the spray gun 60, the ring seal 67 provides an excellent and consistent seal.

As is true in the earlier embodiment, the fluid tip 57 includes a longitudinally extending tubular member 84 which defines a groove 85 at an end 86. An O-ring 87 is positioned within the groove 85 and the end 86 of the tubular member 84 is inserted into the central bore 61 of the spray gun 60. The tubular member 84 together with the O-ring 87 links the assembly 55 to the central bore or passageway 61 of the spray gun 60. In a preferred embodiment, the tubular member 84 also defines an outwardly extending wrench land 88. The wrench land 88 is used during assembly to ensure that the stop member 74 of the fluid tip 57 is positioned tightly against the stop surface 73 of the spray cap 56.

It has been found that fluid tip and air cap assemblies according to the present invention result in superior positioning of such units with respect to each other and to the spray gun and also aid in sealing the passageways within such units. While the present embodiments have been described in detail, various changes and modifications may be made without departing from the scope of the present invention and the following claims.

I claim:

1. A fluid tip and air cap assembly for use in a pneumatic spray gun having a central bore for transporting fluent material, said fluid tip and air cap assembly comprising, in combination, a spray cap having a central opening for the discharge of the fluent material from said spray gun, opposed horns, and auxiliary air passages for shaping the fluent material, said spray cap defining an internal threaded opening and a stop surface defined at an end of said threaded opening, a fluid tip having a tip member mounted concentrically relative to said central opening of said spray cap, a tubular body extending rearwardly from said tip member, said tubular body defining a plurality of threads for mating engagement with said internal threaded opening of said spray cap, a stop member on said fluid tip for engagement with said stop surface of said spray cap, whereby said central opening and said tip member are aligned axially in a predetermined relationship, said spray cap and said fluid tip defining interface surfaces forward of said mating threads, whereby a radial fit exists between said fluid tip and said spray cap to ensure concentric alignment of said central opening of said air cap and tip member, and elastomeric seal means on said tubular body for engaging and sealing to the wall of such central bore of said spray gun.

2. A fluid tip and air cap assembly, according to claim 1, including a wrench land extending from said tubular body of said fluid tip.

3. A fluid tip and air cap assembly, according to claim 1, wherein said stop member on said fluid tip comprises a circular shoulder defined adjacent said plurality of threads.

4. A fluid tip and air cap assembly, according to claim 1, including a seal ring mounted adjacent said spray cap, said seal ring defining at least one air passageway.

5. A fluid tip and air cap assembly, according to claim 1 wherein said elastomeric seal means comprises an O-ring seal.

* * * * *